US008002392B2

(12) United States Patent
Lee et al.

(10) Patent No.: US 8,002,392 B2
(45) Date of Patent: Aug. 23, 2011

(54) INK SUPPLY UNIT, PRINT HEAD ASSEMBLY AND IMAGE FORMING APPARATUS

(75) Inventors: Young-su Lee, Yongin-si (KR); Jin-ho Park, Giheung-gu (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 977 days.

(21) Appl. No.: 11/777,447

(22) Filed: Jul. 13, 2007

(65) Prior Publication Data

US 2008/0170109 A1 Jul. 17, 2008

(30) Foreign Application Priority Data

Jan. 16, 2007 (KR) ..... 10-2007-0004893

(51) Int. Cl.
*B41J 2/175* (2006.01)

(52) U.S. Cl. ..... 347/84

(58) Field of Classification Search ..... 347/40–43, 347/84, 85

See application file for complete search history.

(56) References Cited

U.S. PATENT DOCUMENTS

| | | | | |
|---|---|---|---|---|
| 6,786,570 | B2 * | 9/2004 | Silverbrook | 347/42 |
| 6,796,731 | B2 * | 9/2004 | Silverbrook | 400/77 |
| 6,969,162 | B2 * | 11/2005 | Silverbrook et al. | 347/85 |
| 2002/0180834 | A1 * | 12/2002 | Silverbrook | 347/42 |

FOREIGN PATENT DOCUMENTS

| | | |
|---|---|---|
| CN | 1986231 A | 6/2007 |
| EP | 1138495 | 10/2001 |
| KR | 2000-41224 | 7/2000 |
| KR | 2003-87650 | 11/2003 |
| KR | 2005-123333 | 12/2005 |
| KR | 100667845 | 1/2007 |
| WO | 01/02172 | 1/2001 |
| WO | 02/076748 | 10/2002 |

OTHER PUBLICATIONS

European Search Report issued Jul. 20, 2009 in EP Application No. 07117970.9.

CN Office Action issued Mar. 24, 2011 in CN Application No. 200710186011.3.

* cited by examiner

*Primary Examiner* — An H Do

(74) *Attorney, Agent, or Firm* — Stanzione & Kim, LLP

(57) ABSTRACT

A printhead assembly, an image forming apparatus and an ink supply unit supply color inks to a plurality of printheads which are arranged in a direction transverse to an advancing direction of a printing medium. The ink supply unit may include a first channel member to receive different color inks, a second channel member engaged with the first channel member to divide each of the supplied color inks to a plurality of sets of first unit channels corresponding in number to the plurality of printheads, and a third channel member engaged with the second channel member. A plurality of second unit channels of the third channel member may supply each of the color inks being supplied from the first unit channels to each of the printheads. A support plate may be used to support the first, second, and third channel members in a stack structure.

52 Claims, 6 Drawing Sheets

INK SUPPLY UNIT, PRINT HEAD ASSEMBLY AND IMAGE FORMING APPARATUS

CROSS-REFERENCE TO RELATED APPLICATIONS

This application claims the benefit of priority under 35 U.S.C. §119(a) from Korean Patent Application No. 10-2007-0004893, filed on Jan. 16, 2007, in the Korean Intellectual Property Office, the entire content of which is incorporated herein by reference.

BACKGROUND OF THE INVENTION

1. Field of the Invention

The present general inventive concept relates to an ink supply unit to supply ink to a plurality of printheads arranged in a direction transverse to the advancing direction of a printing medium, and an image forming apparatus having the same.

2. Description of the Related Art

Typically, an image forming apparatus such as an inkjet printer prints a color image on the surface of printing medium (such as paper, fabric, etc.) by firing a droplet of printing ink onto a desired location of printing medium.

A conventional inkjet printer generally reciprocates in a perpendicular relation with respect to the advancing direction of the printing medium. That is, the inkjet printer printhead reciprocates widthwise to the printing medium if the printing medium is traveling along its lengthwise direction (as is typical), to print an image onto the printing medium. Therefore, this conventional inkjet printer prints at a relatively slow speed due to the required reciprocating movement.

A new type of inkjet printer employs a plurality of printheads arranged widthwise to the printing medium, and it omits reciprocating movement of the ink cartridge to therefore provide speedy image printing. This new type of inkjet printer is generally called an "array printhead type inkjet printer."

The array printhead type inkjet printer feeds ink of different colors to a plurality of printheads arranged in a transverse direction relative to the movement of the printing medium. In order to feed the color inks to the printheads individually, the structure of ink supply unit becomes complicated. Assembling the printheads so that the printheads are disposed at the uniform height is also a problem.

SUMMARY OF THE INVENTION

Accordingly, the present general inventive concept provides an ink supply unit which has a simple structure.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an ink supply unit to supply color inks to a plurality of printheads arranged in a direction transverse to an advancing direction of a printing medium. The ink supply unit may include a first channel member to receive different color inks, a second channel member engaged with the first channel member, to divide each of the supplied color inks to a plurality of first unit channels corresponding in number to the plurality of printheads, a third channel member engaged with the second channel member, and having a plurality of second unit channels to supply each of the color inks being supplied through each of the first unit channel to each of the printheads, and a support plate to support the first, second, and third channel members in a stack structure.

The first channel member may include ink supply holes formed in a first side to supply each of the color inks, and a plurality of ink chambers recessed in a second side, individually connected with each of the ink supply holes, and in a parallel arrangement with each other extending in a direction transverse to the advancing direction of the printing medium.

Sealing grooves may be formed in edges of the ink chambers of the first channel member to receive a sealing agent to provide a seal, when the first channel member is engaged with the second channel. The plurality of first unit channels may have different patterns and may be arranged in an alternate fashion.

Each of the first unit channels may include ink inlets formed in a first surface of the second channel member for each of the color inks, and ink outlets formed in a second surface of the second channel member in fluid communication with corresponding ink inlets.

The ink inlets and ink outlets for each of the color inks may be formed to have different sizes.

Sealing grooves may be formed in an edge of each of the ink outlets, to receive a sealing agent.

The second channel member may be fastened to the support plate by a first screw, with the first channel member being interposed between the second channel member and the support plate.

A screw hole to receive the first screw may be formed in a surface of the second channel member adjoining the first channel member.

The first channel member may include a guide groove formed in a side, to guide the first screw such that the first screw is passed therethrough, without being fastened.

The second unit channels may each include ink inlets corresponding to ink outlets of each of the first unit channels, and ink outlets corresponding to the ink inlets of each of the printheads.

The ink outlets of each of the second unit channels may be spaced both a distance away from other ink outlets in a direction transverse to the advancing direction of the printing medium, and a distance away from other ink outlets in the travel direction of the printing medium.

The third channel member may include receiving holes formed in a surface to mount the printheads, to receive a sealing agent to secure a seal between the second unit channels and the printheads.

The surface to mount the printheads of the third channel member may include positioning bosses protruding therefrom to guide the direction of the printheads.

The surface to mount the printheads of the third channel member may include stoppers to regulate the height of the printheads.

The plurality of second unit channels may be arranged in an alternate fashion in an odd-numbered row, and in an even-numbered row in the direction transverse to the advancing direction of the printing medium.

The third channel member may include passing holes through which second screws are passed to fasten the printheads to the third channel member.

The second channel member may include nut holes in a surface adjoining the third channel member to engage with the second screws.

The first, second, and third channel members may include guide ribs and corresponding guide holes formed in surfaces adjoining each other, to assist properly positioning the first, second and third channel members relative to each other.

The first, second and third channel members may include screw holes formed on the same locations of each of the opposite ends, through which screws are passed and fastened to the support plate.

The support plate may be formed of a metal material to support the first, second, and third channel units and prevent the deformation of the first, second, and third channel units.

The support plate may be formed of a stainless metal material, such as stainless steel.

The support plate comprises a reinforcing rib bent from a side thereof, to restrain a widthwise deformation.

The foregoing and/or other aspects and utilities of the present general inventive concept may also be achieved by providing a printhead assembly including a plurality of printheads arranged in a direction transverse to an advancing direction of a printing medium, and an ink supply unit to support each of the plurality of printheads, and divide color inks to independently supply each of the color inks to the plurality of printheads.

The ink supply unit may include a first channel member to receive different color inks, a second channel member engaged with the first channel member, to divide each of the supplied color inks to a plurality of first unit channels corresponding in number to the plurality of printheads, a third channel member engaged with the second channel member, and having a plurality of second unit channels to supply each of the color inks being supplied through each of the first unit channel to each of the printheads, and a support plate to support the first, second, and third channel members in a stack structure.

The plurality of first unit channels of different patterns may be arranged in an alternate fashion.

The second channel member may be fastened to the support plate by a first screw, with the first channel member being interposed between the second channel member and the support plate.

The second unit channels may each include ink inlets corresponding to ink outlets of each of the first unit channels, and ink outlets corresponding to the ink inlets of each of the printheads.

A sealing agent may be disposed between the third channel member and the printheads.

The third channel member may include a receiving groove recessed in a surface to mount the printheads, to receive the sealing agent therein.

The third channel member may include positioning bosses protruding from a surface to mount the printheads, to guide the direction of the printheads.

The third channel member may include stoppers protruding from a surface to mount the printheads, to regulate the height of the printheads.

A plurality of sets of second unit channels (each set corresponding to a printhead) may be provided in two or more rows extending in a direction transverse to an advancing direction of the printing medium. With two rows, the sets of second unit channels may be arranged such that sets of the second unit channels in the first row alternate with sets of the second unit channels in the second row.

The second channel member may include nuts supported on an adjoining surface between the second channel member and the third channel member, such that the screws to fasten the printheads to the third channel member are engaged with the nuts.

The first, second, and third channel members may include guide ribs and guide grooves corresponding the guide ribs, formed in surfaces adjoining each other, to assist properly positioning the first, second and third channel members relative to each other.

The printheads at odd-numbered locations in the transverse direction may be arranged in a first row, and the printheads at even-numbered locations in the transverse direction are arranged in a second row which is spaced apart from the first row in the advancing direction of the printing medium.

Signal cables may be connected individually to each of the plurality of printheads.

The signal cables may be connected to the plurality of printheads from the same direction.

The signal cables may have the same length.

A cover member including holes to expose the printheads therethrough, may be further provided. The cover member may be engaged with the ink supply unit to cover the signal cables.

The printheads may each include nozzle inlets formed on a first surface for each of the color inks, and sized to correspond to the second unit channels, and nozzle outlets formed on a second surface in fluid communication with the nozzle inlets, and extending in the transverse direction.

An inclined surface may be formed between the nozzle inlets and the nozzle outlets of the printheads.

The foregoing and/or other aspects and utilities of the present general inventive concept may also be achieved by providing an image forming apparatus to form an image by firing an ink onto an advancing printing medium, the image forming apparatus including a plurality of printheads arranged in a direction transverse to an advancing direction of a printing medium, and an ink supply unit to support each of the plurality of printheads, and divide color inks to independently supply each of the color inks to the plurality of printheads.

The ink supply unit may include a first channel member to receive different color inks according to color of the ink, a second channel member engaged with the first channel member, to divide each of the supplied color inks to a plurality of first unit channels corresponding in number to the plurality of printheads, a third channel member engaged with the second channel member including a plurality of second unit channels to supply each of the color inks being supplied through each of the first unit channel to each of the printheads, and a support plate to support the first, second, and third channel members in a stack structure.

The foregoing and/or other aspects and utilities of the present general inventive concept may also be achieved by providing a method of forming an image, including transferring N inks from N ink tanks to inlets of a first channel member; within the first channel member, transferring each ink along a corresponding channel formed therein in a direction transverse to an advancing direction of the printing medium; transferring each of the N inks from its corresponding channel in the first channel member to M sets of first unit channels within a second channel member, wherein M is an integer, each set of unit channels being dedicated to a single corresponding printhead; for each set of first unit channels, transferring each of the N inks to the single corresponding printhead; and ejecting one or more inks from printheads arranged in the direction transverse to the advancing direction of the printing medium as desired to thereby form an image.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
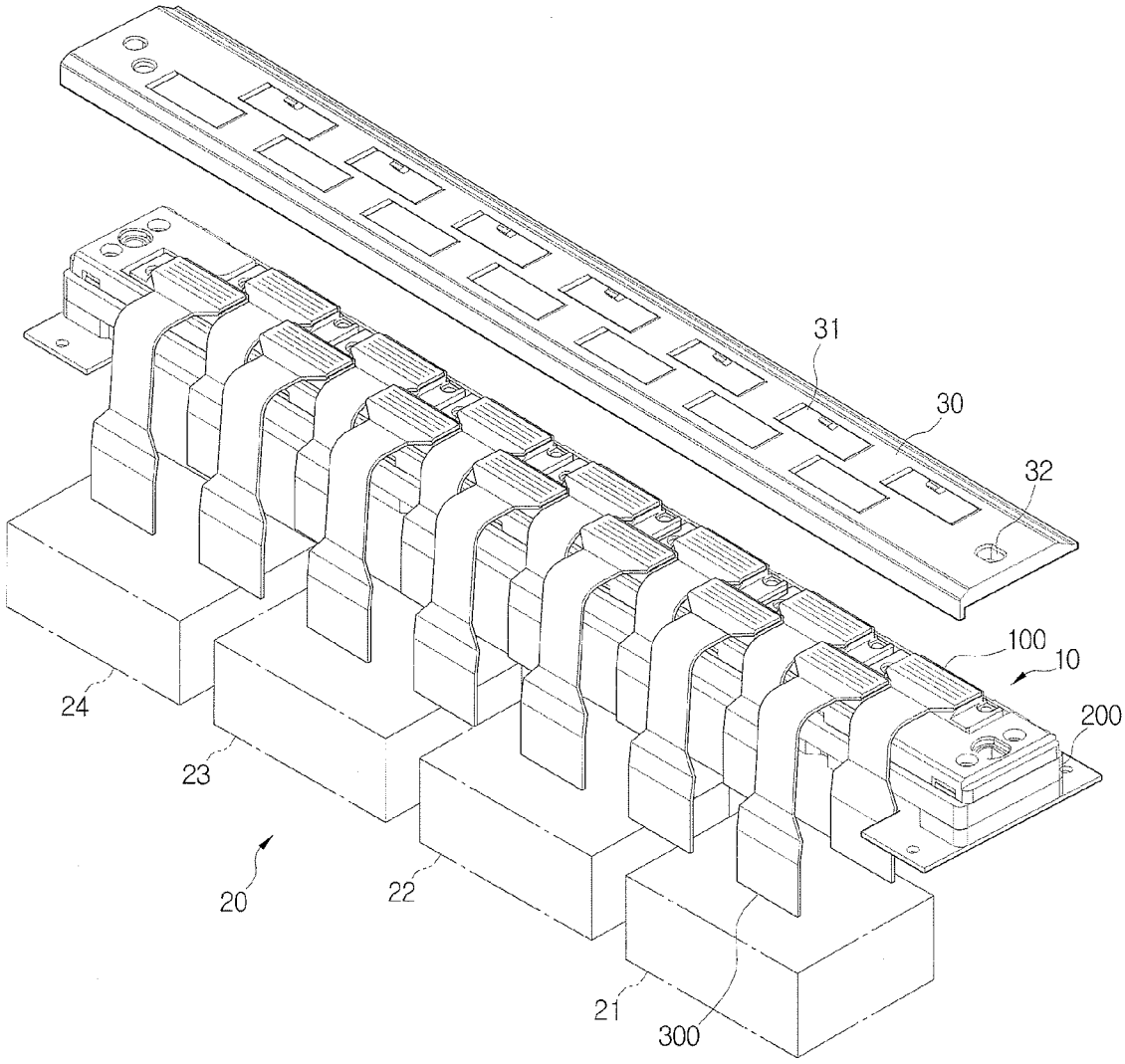
FIG. 1 is a perspective view of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
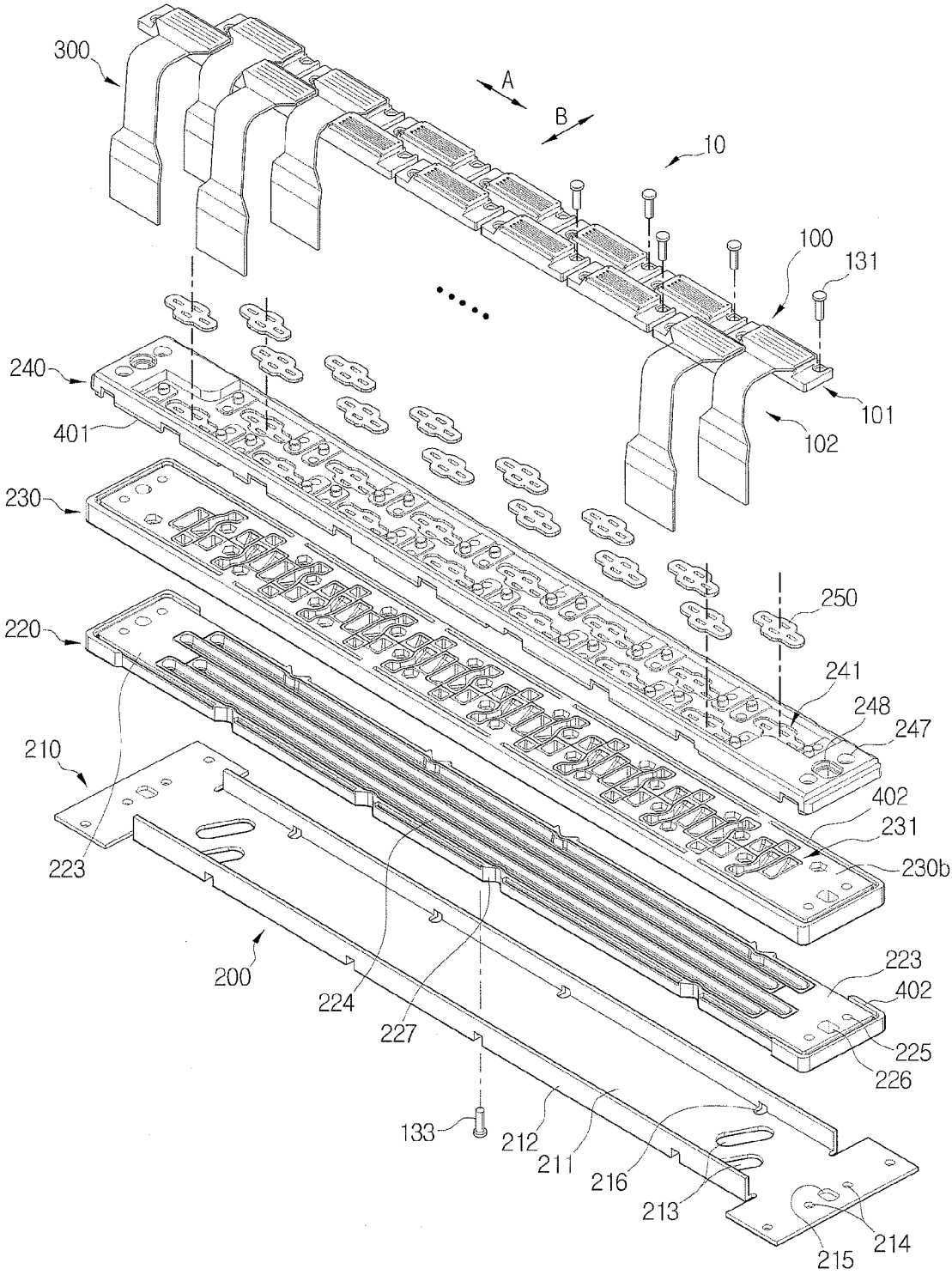
FIGS. 2 and 3 are exploded views of the printhead assembly of FIG. 1.
Figure 3:
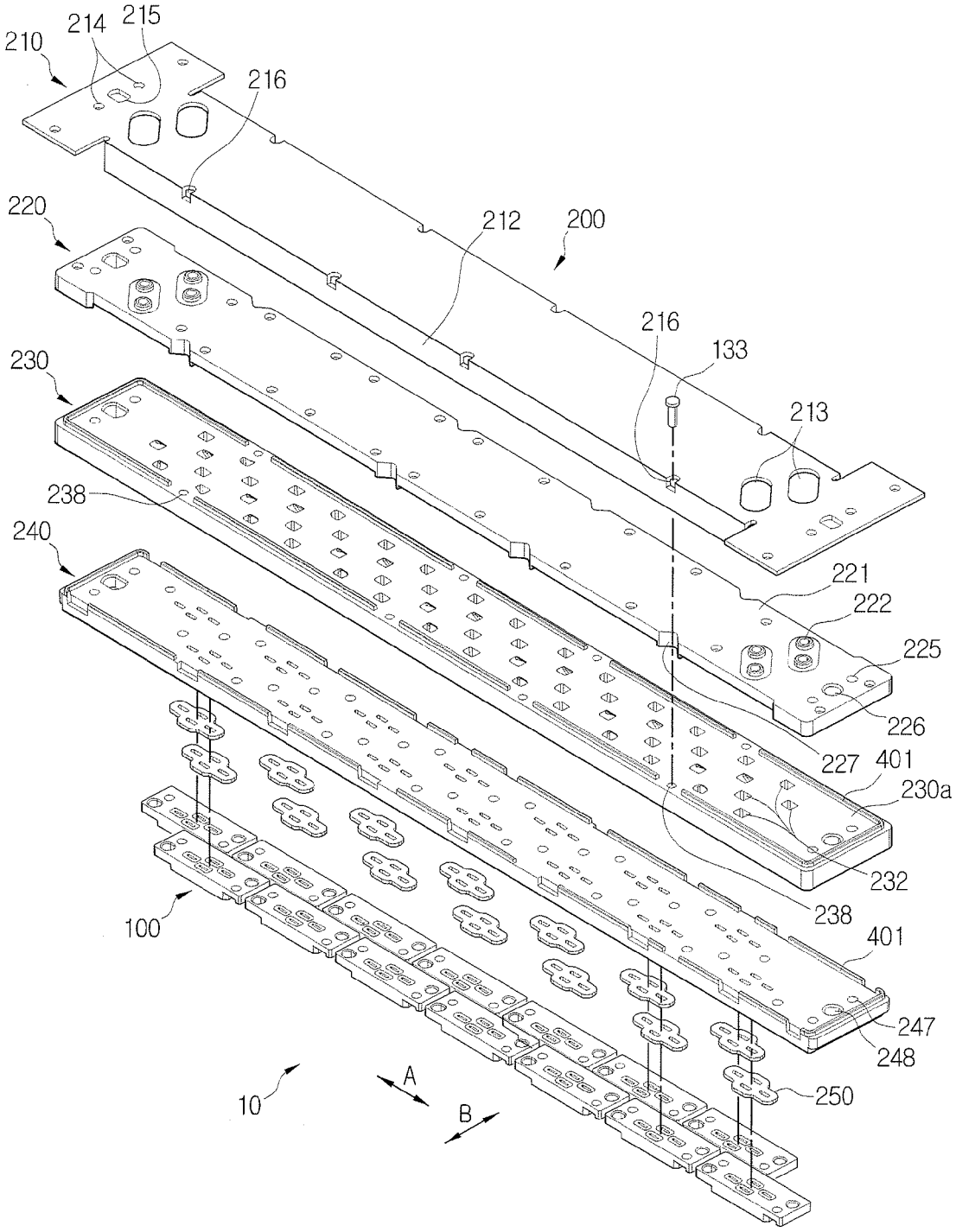

Referring to FIGS. 1, 2 and 3, an image forming apparatus according to an exemplary embodiment includes a printhead assembly 10 to eject ink directly onto a conveyed printing medium and form a desired image, and a plurality of ink tanks 20 to supply ink to the printhead assembly 10.

The printhead assembly 10 includes a plurality of printheads 100 aligned transverse to the advancing direction of the printing medium. Typically this means that the printheads 100 are formed widthwise to the printing medium. FIGS. 2 and 3 illustrate the advancing direction of the printing medium as direction "B" (referred to in this disclosure as "advancing direction"), and the direction transverse to the advancing direction of the printing medium as direction "A" (referred to in this application as "transverse direction"). Also illustrated is an ink supply unit 200 to supply color inks to each of the printheads 100.

The plurality of ink tanks 20 may include a plurality of tanks 21, 22, 23, 24 to hold different color inks, such as yellow ink (Y), magenta ink (M), cyan ink (C) and black ink (K).

The ink tanks 21, 22, 23, 24 may be configured to be recharged with the ink of the refill tank, or may be configured in a removable manner to be replaced when exhausted.

The color inks of the ink tanks 21, 22, 23, 24 are fed into the printheads 100 individually, through the ink supply unit 200.

The printheads 100 are arranged in first and second rows 101, 102. First and second rows 101, 102 are spaced apart from each other in the advancing direction (B) of the printing medium. The printheads 100 in the first row 101 may be odd-numbered printheads, while the printheads 100 in the second row 102 may be even-numbered in the transverse direction (A).

Figure 4A:
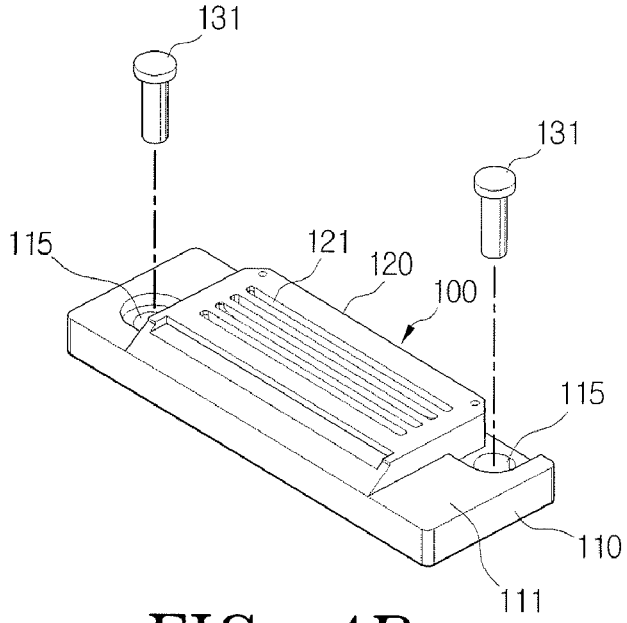
FIG. 4A is a perspective view of the printhead of FIG. 2.
Figure 4B:
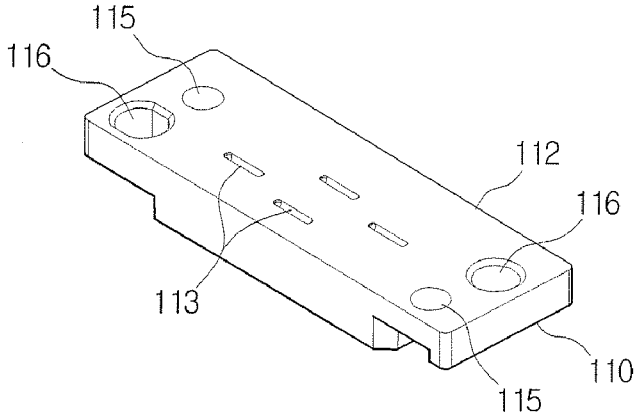
FIG. 4B is a bottom perspective view of the printhead of FIG. 4A.
Figure 4C:
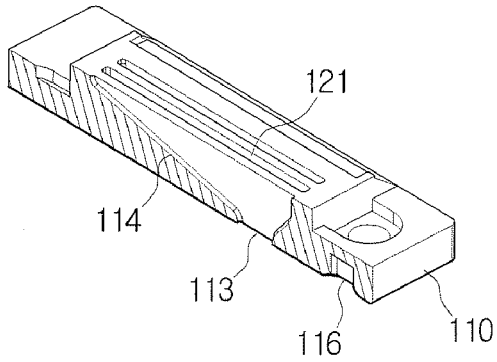
FIG. 4C is a perspective view and in partial section, of FIG. 4A.

As illustrated in FIGS. 4A, 4B and 4C, head parts 120 of the printheads 100 are exposed through first sides 111 of head modules 110. Each head part 120 has nozzle outlets 121 through which ink is fired. Head module 110 may include a nozzle outlet 121 for each of the color inks. In this example, four nozzle outlets 121 are arranged side by side in the advancing (B) direction, spaced apart at a distance from each other.

Nozzle inlets 113 are formed in second sides 112 of the head modules 110. The nozzle inlets 113 are smaller in size than the nozzle outlets 121, are formed at different locations and isolated from each other. The nozzle outlets 121 are connected with the nozzle inlets 113 to pass each of the color inks. A slope 114 is formed along a channel that connects the nozzle outlet 121 and the nozzle inlet 113. Accordingly, bubbles, when generated at or around the nozzle outlets 121, are guided along the slope 114 and collected at the nozzle inlets 113.

A pair of coupling holes 115 is formed in opposite ends of each head module 110, to receive coupling screws 131 (that is, second screws). The coupling holes 115 are spaced apart from each other along a line diagonal to the advancing (B) and transverse (A) directions, with the head part 120 intervening therebetween. The second screws 131 are passed through the coupling holes 115 and fastened to nuts 132 of a first channel member 220 (explained in detail below).

A pair of positioning holes 116 is formed to a predetermined depth in the second side 112 of each head module 110, to guide the direction of positioning and fastening the printheads 110. The positioning holes 116 are spaced apart from each other along a line diagonal to the advancing (B) and transverse (A) directions, with the head part 120 intervening therebetween. The positioning holes 116 are in the proximity to the coupling holes 115, respectively. In the first side 111, a depression is formed in an adjoining area around each of the coupling holes 115 in order to receive the head of the coupling screw 131, thereby preventing the head of the coupling screw 131 from protruding out of the first side 111.

Signal cables, such as a flexible printed circuit (FPC) 300, having nozzle chips, are connected to each of the head parts 120 of the printheads 100, individually. The signal cables 300 have the same lengths, and extend to connect to the printheads 100 in the same direction. Accordingly, the signal cables 300 are positioned between the respective printheads 100. Because the coupling screws 131 are fastened in a manner that the heads of the coupling screws 131 are not exposed out of the first side 111, the signal cables 300 are smoothly guided and installed between the printheads 100. Because the signal cables 300 have the same length, impedance variation is minimized, and as a result, stable ink firing is provided.

Because the signal cables 300 extend in the same direction, a circuit board, to which the signal cables 300 are connected, can be sized smaller, and as a result, a cost reduction is realized.

The ink supply unit 200 of this example includes a support plate 210, a first channel member 220, a second channel member 230, and a third channel member 240, which engage with each other in a stack structure.

The support plate 210 supports the ink supply unit 200 stably, and prevents possible deformation of the ink supply unit 200. That is, the support plate 210 compensates for the deformation of the ink supply unit 200. The support plate 210 may desirably be formed of a metal material such as stainless steel. The support plate 210 includes a platen body 211 in tight contact with the first channel member 220, and reinforcing ribs 212 bent up at opposite sides of the platen body 211. The reinforcing ribs 212 are bent up and extended to contact with the sides of the first channel member 220, to reinforce the resistance against the force that bends the support plate 210 lengthwise.

A plurality of guide holes 213 is formed in opposite ends of the support plate 210, to expose ink supply ports 221 of the first channel member 220. The support plate 210 also includes first coupling holes 214 to screw couple with the plurality of channels 220, 230, 240. Second coupling holes are provided to attach a cover member 30 (explained below) and the ink supply unit 200 to the main body of the image forming apparatus. Third coupling holes 216 are provided to screw couple with the second channel member 230, with the intervention of the first channel member 220 therebetween.

The first channel member 220 receives color inks from the ink tanks 21, 22, 23, 24. Accordingly, the first channel member 220 has ink supply passages 222 for the respective color inks on its first side 221. The first channel member 220 has a plurality of ink chambers 224 on its second side 223, corresponding to different color inks. The ink chambers 224 are elongated in the transverse direction (A) and arranged side by side in the advancing direction (B). The ink chambers 224 in this example are Y, M, C and K ink chambers. The ink chambers 224 have the same length, and spaced apart from each other in the B direction.

Figure 5:
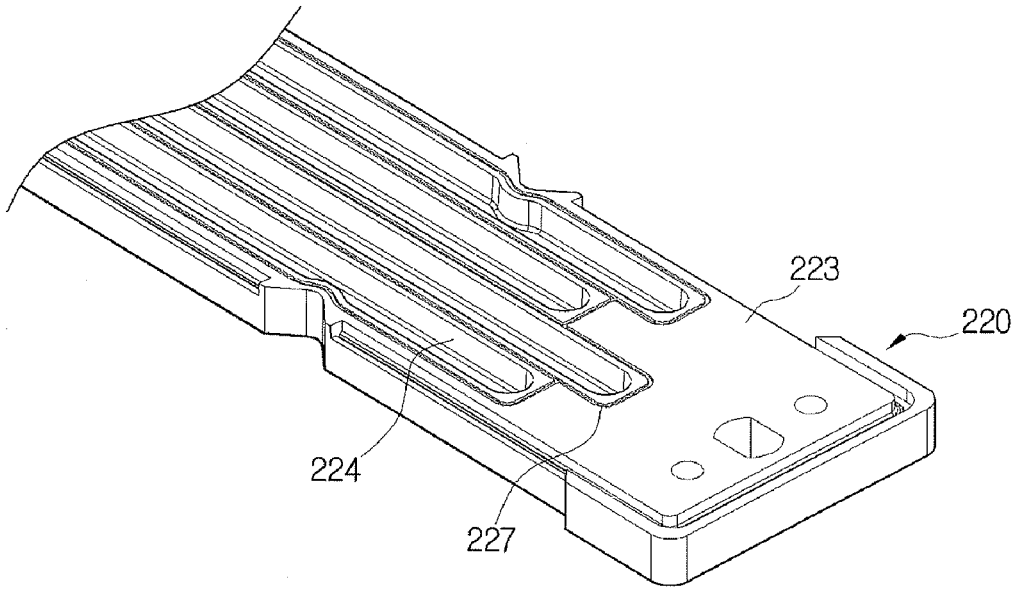
FIG. 5 is an enlarged view of the first channel member of FIG. 2.

Fastening holes 225, 226 are formed in opposite ends of the first channel member 220 and correspond to the first and second coupling holes 214, 215 of the support plate 210. Referring to FIG. 5, a receiving groove 227 is formed around each of the ink chambers 224 in the second side 223 of the first channel member 220, and each receiving groove 227 receives a sealing agent therein. The sealing agent is added to prevent leakage of ink of the ink chamber 224, when the first and second channel members 220, 230 are engaged with each other.

The second channel member 230 is fastened between the first and third channel members 220, 240. The second channel member 230 distributes the ink supply received through the first channel member 220 into streams of the respective color inks, such that the color inks are respectively supplied to the printheads 100. The second channel member 230 includes a plurality of first unit channels 231 to distribute each color ink into a plurality of streams corresponding to the number of the printheads 100.

Figure 6:
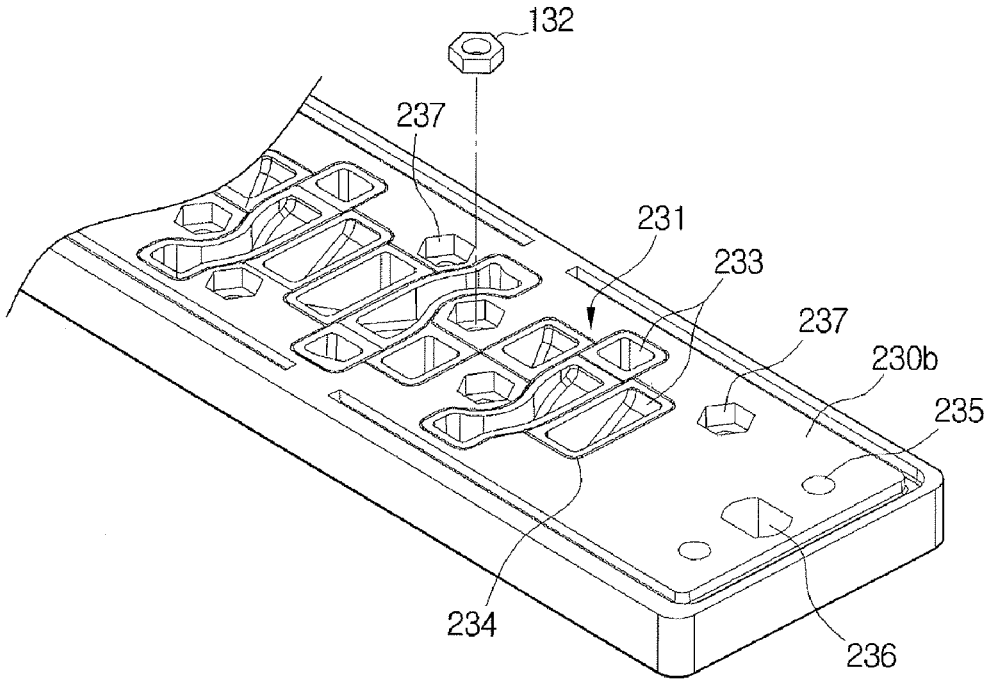
FIG. 6 is an enlarged view of the second channel member of FIG. 2.

Each of the first unit channels 231 includes an ink inlet 232 formed in a first side 230*a* of the second channel member 230, and as illustrated in FIG. 6, an ink outlet 233 formed in a second side 230*b* of the second channel member 230. The first unit channel 231 illustrated here includes four ink inlets 232 and four ink outlets 233, respectively. The ink inlets 232 are in fluid communication with the ink outlets 233 to pass each of the color inks. The ink inlets 232 are at locations corresponding to the ink chambers 224 of the first channel member 220. The ink outlets 233 are formed at an area adjoining the third channel member 240. Some of the ink outlets 233 are larger in size than the ink inlets 232.

The first unit channels 231 may be formed in different patterns. Here, the first unit channels have two different patterns and are formed in an alternating order in the transverse (A) direction. In this example, two neighboring first unit channels 231 are in a diagonally symmetric relationship with each other. According to the alternating patterns of the first unit channels 231, the respective color inks are supplied to the printheads 100 of the first and second printhead rows 101, 102, individually.

A sealing groove 234 is formed in the second side 230*b* of the second channel member 230 to a predetermined depth. The sealing groove 234 extends around the ink outlet 233. A sealing agent is applied to the sealing groove 234 so that, after the second and third channel members 230, 240 are bonded with each other, leakage of ink through the ink outlet 233 can be prevented, and as a result, blending of different color inks can be prevented. Fastening holes 235, 236 corresponding to the first and second coupling holes 214, 215 of the support plate 210, are formed on opposite ends of the second channel member 230.

Referring to FIG. 6, in the second side 230*b* of the second channel member 230, nut holes 237 to receive nuts 132 are is formed. The nut holes 237 are formed to a depth such that the nuts 132, when received in the nut holes 237, do not protrude out of the second side 230*b*. The nuts 132 correspond to the second screws 131 which fasten the printheads 100 to the third channel member 240, individually, and pass through the third channel member 240 and engaged with the nuts 132. Instead of forming a nut coupling integral with the second channel member 230, nuts 132 are separately formed, and engaged with the second screws 131, such that wearing out of the nuts 132 by the repeated fastening and unfastening for the replacement of the printheads 100, can be prevented, and as a result, bad coupling can be prevented.

The third channel member 240 is fastened in contact with the second channel member 230. The third channel member 240 in this example includes second unit channels 241 to supply the streams of color inks supplied from the first unit channels 131 to the respective printheads 100. The second unit channels 241 are passed through the third channel member 240, and have inlets and outlets of same pattern and size.

Sets of second unit channels 241 are arranged in first and second rows, to correspond to the printheads 100 of the first and second rows 101, 102.

Figure 7:
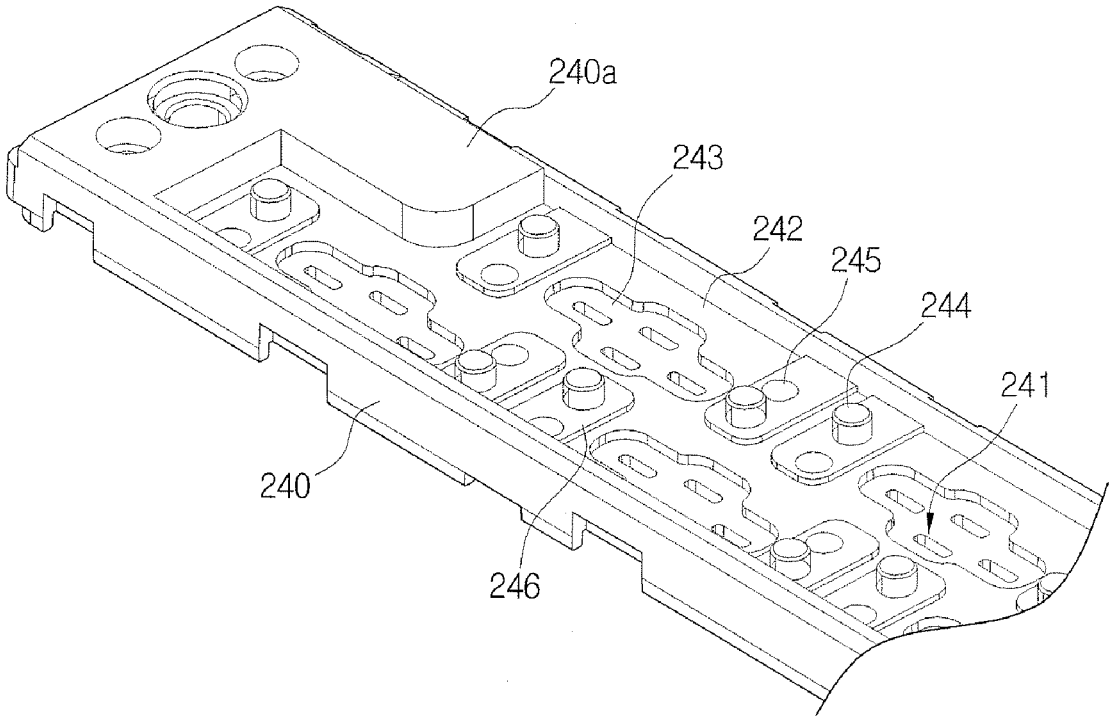
FIG. 7 is an enlarged view of the third channel member of FIG. 2.

Sealing members 250 are disposed between the second unit channels 241 and the printheads 100. Referring to FIG. 7, a printhead mount surface 242 of the third channel member 240 is recessed to a predetermined depth from an outer surface 240*a* to a printhead mount surface 242 of the third channel member 240. Within this recess, a plurality of sealing member receiving recesses 243 are formed in the printhead mount surface 242. Each sealing member mount receiving recess 243 receives a sealing member 250. Outlets of the second unit channel 241 are positioned in the sealing member receiving recess 243.

Positioning bosses 244 protrude from the printhead mount surface 242, to guide the printheads 100 when the printheads are mounted. The positioning bosses 244 are formed at a height and a location to correspond to the positioning holes 116 of the printheads 100 (FIGS. 4B and 4C). Screw passing holes 245 are formed in proximity to the positioning bosses 244. The second screws 131 pass through the printheads 100, and the screw passing holes 245, to be engaged with the nuts 132 of the second channel member 130.

Stoppers 246 protrude from the printhead mount surface 242 to keep the printheads 100 at a constant height, that is, to keep a constant distance between the printheads 100 and the printing medium. As the printheads 100 are engaged in tight contact with the stoppers 246, the printheads 100 can be aligned at a constant height.

Fastening holes 247, 248 are also formed on opposite ends of the third channel member 240 to correspond to the first and second coupling holes 214, 215 of the support plate 210. Screws pass through the fastening holes 247, and through the second and first channel members 230, 220, and coupled with the first coupling holes 214.

The number of sealing members 250 corresponds to the number of printheads 100, and the sealing members 250 have holes corresponding in location with the second unit channels 241.

Before the third channel member 240 is engaged with the first and second channel members 220, 230, the first and second channel members 210, 220 are fastened to the support plate 210. To this end, the second channel member 230 has fastening holes 238 corresponding to the third coupling holes 216 of the support plate 210. The first channel member 220 includes guiding grooves 227 formed on the side, to guide first screws 133 so that the first screws 133 may freely pass while being coupled with the coupling holes 216, 238.

Referring to FIG. 1, a cover member 30 attached to the ink supply unit 200 is provided to cover the signal cable 300, when the printheads 100 and the signal cable 300 are engaged with each other.

The cover member 30 includes a plurality of holes 31 formed at locations corresponding to the printheads 100 such that the printheads 100 are exposed through the holes 31. The cover member 30 is engaged with, and covers the third channel member 240 such that the printheads 100 are exposed through the plurality of holes 31 of the cover member 30. The cover member 30 is fastened with screws which pass through screw holes 32 provided at opposite ends of the cover member 30. These screws pass through the supply unit 200 and are fixed to the main body frame (not illustrated) of the image forming apparatus.

Referring to FIGS. 2 and 3, guide ribs 401 and guide holes 402 corresponding to the guide ribs 401, are formed in the adjoining areas between the first, second and third channel members 220, 230, 240. Accordingly, the channel members 220, 230, 240 are aligned and engaged with each other firmly.

As explained above, with an image forming apparatus according to the exemplary embodiments of the present general inventive concept, the plurality of printheads are assembled to the third channel member, individually, by respective screws. As a result, only an affected printhead may be replaced when an error occurs, and cost for maintaining and repair is accordingly reduced.

Furthermore, by providing the screws and nuts to assemble the printheads separately on the second channel member, wear-out due to repeated fastening and unfastening of the screws can be prevented, while maintaining the printheads in a firmly assembled state.

Furthermore, in assembling the printheads, the direction of the printheads can be aligned by use of stoppers, such that the distance between printheads and the printing medium can be kept constant. Because each of the printheads are independently mounted, a printhead may be individually adjusted and aligned with reference to the other printheads, when the printhead has different height from the other printheads.

Furthermore, by connecting the signal cable to the printheads from one direction, the size of circuit board connected with the signal cables can be reduced.

Also by having the signal cables of the same length, impedance deviation between the signal cables can be minimized, and stable ink firing can be provided.

Also by assembling the first, second and third channel members in a stack structure and then fastening the structure to a metal support plate, deformation of the channel members can be prevented. As a result, poor printing quality, due to an unstable supply of ink and/or misalignment of printheads by the deformation of the channel members, can be minimized.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An ink supply unit to supply color inks to a plurality of printheads arranged in a direction transverse to an advancing direction of a printing medium, comprising:

a first channel member to receive N different color inks, where N is an integer;

a second channel member engaged with the first channel member, including M×N first unit channels, where M is the number of printheads, wherein for each of the supplied color inks, the second channel member is operable to divide the color ink to respective M first unit channels;

a third channel member engaged with the second channel member, and including M×N second unit channels to supply each of the color inks being supplied through each of the first unit channels to each of the printheads; and a support plate to support the first, second, and third channel members in a stack structure.

2. The ink supply unit of claim 1, wherein the first channel member comprises:

ink supply holes formed in a first side, to supply each of the color inks; and a plurality of ink chambers recessed in a second side, individually connected with each of the ink supply holes, elongated in the direction transverse to the advancing direction and in a parallel arrangement with each other.

3. The ink supply unit of claim 2, further comprising sealing grooves formed in edges of the ink chambers of the first channel member to receive a sealing agent to provide a seal.

4. The ink supply unit of claim 1, wherein the plurality of first unit channels are arranged in M sets of N, and neighboring sets of first unit channels have different patterns.

5. The ink supply unit of claim 4, wherein each of the sets of first unit channels comprises:

ink inlets formed in a first surface of the second channel member, for each of the color inks, and ink outlets formed in a second surface of the second channel member, in fluid communication with the ink inlets.

6. The ink supply unit of claim 5, wherein for a set of first channel units, the ink inlets and ink outlets for each of the color inks have different sizes.

7. The ink supply unit of claim 5, further comprising sealing grooves formed in an edge of each of the ink outlets, to receive a sealing agent.

8. The ink supply unit of claim 1, wherein the second channel member is fastened to the support plate by a first screw, with the first channel member being interposed between the second channel member and the support plate.

9. The ink supply unit of claim 8, further comprising a screw hole to receive the first screw, formed in a surface of the second channel member adjoining the first channel member.

10. The ink supply unit of claim 8, wherein the first channel member comprises a guide groove formed in a side, to guide the first screw such that the first screw is passed therethrough, without being fastened.

11. The ink supply unit of claim 1, wherein the second unit channels each comprise:

ink inlets corresponding to ink outlets of each of the first unit channels; and ink outlets corresponding to the ink inlets of each of the printheads.

12. The ink supply unit of claim 11, wherein M sets of second unit channels are provided each corresponding to a respective printhead, wherein the ink outlets of each set of the second unit channels are spaced a distance away from other ink outlets of other sets of the second unit channels in the transverse direction to the advancing direction of the printing medium, and spaced apart from other ink outlets of other sets of the second unit channels in an advancing direction of the printing medium.

13. The ink supply unit of claim 1, wherein the third channel member comprises receiving holes formed in a surface to mount the printheads, to receive a sealing agent to seal between the second unit channels and the printheads.

14. The ink supply unit of claim 13, wherein the surface to mount the printheads comprises positioning bosses protruding therefrom, to guide the direction of the printheads.

15. The ink supply unit of claim 13, wherein the mount surface to mount the printheads comprises stoppers to regulate the height of the printheads.

16. The ink supply unit of claim 1, wherein M sets of second unit channels are provided each corresponding to a respective printhead, and wherein M sets of second unit channels are arranged in first and second rows extending in the transverse direction, such that odd-numbered sets of second unit channels are arranged in the first row and even numbered sets of second unit channels are arranged in the second row.

17. The ink supply unit of claim 1, wherein the third channel member comprises passing holes through which second screws are passed to fasten the printheads to the third channel member.

18. The ink supply unit of claim 17, wherein the second channel member comprises nut holes in a surface adjoining the third channel member, to engage with the second screws.

19. The ink supply unit of claim 1, wherein the first, second, and third channel members comprise guide ribs and corresponding guide holes formed in surfaces adjoining each other, to position of the first, second and third channel members relative to each other.

20. The ink supply unit of claim 1, wherein the first, second and third channel members comprise screw holes formed at each of their opposite ends at the same locations relative to the other channel members, through which screws are passed and fastened to the support plate.

21. The ink supply unit of claim 1, wherein the support plate is formed of a metal material to support the first, second, and third channel units and prevent the deformation of the first, second, and third channel units.

22. The ink supply unit of claim 21, wherein the support plate is formed of a stainless metal.

23. The ink supply unit of claim 21, wherein the support plate comprises a reinforcing rib bent from an elongated side thereof.

24. A printhead assembly, comprising:

a plurality of printheads arranged in a direction transverse to an advancing direction of a printing medium; and an ink supply unit to support each of the plurality of printheads, and to divide color inks to independently supply each of the color inks to the plurality of printheads, wherein the ink supply unit comprises:

a first channel member to receive N different color inks, where N is an integer;

a second channel member engaged with the first channel member, to divide each of the supplied color inks to M first unit channels, where M is the number of printheads;

a third channel member engaged with the second channel member, and including M×N second unit channels to supply each of the color inks being supplied through each of the first unit channel to each of the printheads; and a support plate to support the first, second, and third channel members in stack structure.

25. The printhead assembly of claim 24, wherein the first channel member comprises:

ink supply holes formed in a first side, to supply each of the color inks; and a plurality of ink chambers recessed in a second side, individually connected with each of the ink supply holes, elongated in the direction transverse to the advancing direction and in a parallel arrangement with each other.

26. The printhead assembly of claim 24, wherein the plurality of first unit channels are arranged in M sets of N first unit channels, and neighboring sets of first unit channels have different patterns.

27. The printhead assembly of claim 24, wherein the second channel member is fastened to the support plate by a first screw, with the first channel member being interposed between the second channel member and the support plate.

28. The printhead assembly of claim 24, wherein the second unit channels each comprise:

ink inlets corresponding to ink outlets of each of the first unit channels; and ink outlets corresponding to the ink inlets of each of the printheads.

29. The printhead assembly of claim 24, further comprising a sealing agent disposed between the third channel member and the printheads.

30. The printhead assembly of claim 29, wherein the third channel member comprises a receiving groove recessed in a surface to mount the printheads, to receive the sealing agent therein.

31. The printhead assembly of claim 24, wherein the third channel member comprises positioning bosses protruding from a surface to mount the printheads, to guide the direction of the printheads.

32. The printhead assembly of claim 24, wherein the third channel member comprises stoppers protruding from a surface to mount the printheads, to regulate the height of the printheads.

33. The printhead assembly of claim 24, wherein M sets of second unit channels are provided, each corresponding to a respective printhead, and wherein the M sets of second unit channels are provided in first and second rows extending in the direction transverse to the advancing direction of the printing medium, in an arrangement in which sets of the second unit channels in the first row alternate with sets of the second unit channels in the second row.

34. The printhead assembly of claim 24, wherein the second channel member comprises nuts supported on an adjoining surface between the second channel member and the third channel member, such that the screws to fasten the printheads to the third channel member are engaged with the nuts.

35. The printhead assembly of claim 24, wherein the first, second, and third channel members comprise guide ribs and guide grooves corresponding the guide ribs, formed in surfaces adjoining each other, to position the first, second and third channel members relative to each other.

36. The printhead assembly of claim 24, wherein the printheads at odd-numbered locations in the direction transverse to the advancing direction are arranged in a first row, and the printheads at even-numbered locations in the direction transverse to the advancing direction are arranged in a second row which is spaced apart from the first row in the advancing direction of the printing medium.

37. The printhead assembly of claim 24, further comprising signal cables connected individually to each of the plurality of printheads.

38. The printhead assembly of claim 37, wherein the signal cables are connected to the plurality of printheads from the same direction.

39. The printhead assembly of claim 37, wherein the signal cables have the same length.

40. The printhead assembly of claim 37, further comprising a cover member including holes to expose the printheads therethrough, the cover member engaged with the ink supply unit to cover the signal cables.

41. The printhead assembly of claim 24, wherein the printheads each comprise nozzle inlets formed on a first surface for each of the color inks, and sized to correspond to the second unit channels, and nozzle outlets formed on a second surface in fluid communication with the nozzle inlets, and elongated in the direction transverse to the advancing direction.

42. The printhead assembly of claim 41, wherein an inclined surface is formed within a channel between the nozzle inlets and the nozzle outlets of the printheads.

43. An image forming apparatus to form an image by firing an ink onto an advancing printing medium, comprising:

a plurality of printheads arranged in a direction transverse to the advancing direction of the printing medium; and an ink supply unit to support each of the plurality of printheads, and to divide color inks to independently supply each of the color inks to the plurality of printheads, wherein the ink supply unit comprises:

a first channel member to receive N different odor inks, where N is an integer;

a second channel member engaged with the first channel member, including M×N first unit channels, where M is the number of printheads, wherein for each of the supplied color inks, the second channel member is operable to divide the color ink to respective M first unit channels;

a third channel member engaged with the second channel member, and including M×N second unit channels to supply each of the color inks being supplied through each of the first unit channels to each of the printheads; and a support plate to support the first, second, and third channel members in a stack structure.

44. The image forming apparatus of claim 43, wherein the second channel member is fastened to the support plate with a first screw, with the first channel member being interposed between the second channel member and the support plate.

45. The image forming apparatus of claim 43, further comprising a sealing agent disposed between the third channel member and the printheads.

46. The image forming apparatus of claim 43, wherein the third channel member comprises positioning bosses protruding from a surface to mount the printheads, to guide the direction of the printheads.

47. The image forming apparatus of claim 43, wherein the third channel member comprises stoppers protruding from a surface to mount the printheads, to regulate the height of the printheads.

48. The image forming apparatus of claim 43, further comprising signal cables connected individually to each of the plurality of printheads.

49. The image forming apparatus of claim 48, wherein the signal cables are connected to the plurality of printheads from the same direction.

50. The image forming apparatus of claim 49, wherein the signal cables have the same length.

51. The image forming apparatus of claim 43, further comprising a cover member including holes to expose the printheads therethrough, the cover member engaged with the ink supply unit to cover the signal cables.

52. The image forming apparatus claim 43, wherein the printheads are arranged in a first and second rows extending in a direction transverse to the advancing direction of the printing medium, and the printheads in the first row alternate with the printheads in the second row in the direction transverse to the advancing direction.

* * * * *